US012233306B2

(12) United States Patent
Liu

(10) Patent No.: US 12,233,306 B2
(45) Date of Patent: Feb. 25, 2025

(54) KETTLEBELL

(71) Applicant: OHFG TECHNOLOGIES(SHANGHAI) CO., LTD, Shanghai (CN)

(72) Inventor: Ping Liu, Shanghai (CN)

(73) Assignee: OHFG TECHNOLOGIES(SHANGHAI) CO.,LTD, Shanghai (CN)

( * ) Notice: Subject to any disclaimer, the term of this patent is extended or adjusted under 35 U.S.C. 154(b) by 171 days.

(21) Appl. No.: 18/324,932

(22) Filed: May 26, 2023

(65) Prior Publication Data

US 2024/0382796 A1 Nov. 21, 2024

(30) Foreign Application Priority Data

May 18, 2023 (CN) ..... 202310567410.3

(51) Int. Cl.
*A63B 21/075* (2006.01)

(52) U.S. Cl.
CPC ..... *A63B 21/075* (2013.01)

(58) Field of Classification Search
CPC ..... A63B 21/072; A63B 21/075
See application file for complete search history.

(56) References Cited

U.S. PATENT DOCUMENTS

| | | | | |
|---|---|---|---|---|
| 10,166,429 | B2 * | 1/2019 | Chen | A63B 21/0728 |
| 10,420,978 | B2 * | 9/2019 | Wang | A63B 21/072 |
| 10,463,906 | B2 * | 11/2019 | Owusu | A63B 21/072 |
| 10,695,614 | B2 * | 6/2020 | Owusu | A61B 5/6895 |
| 11,185,731 | B2 * | 11/2021 | Wang | A63B 21/075 |
| 11,324,989 | B2 * | 5/2022 | Slater | A63B 21/0726 |
| 11,344,764 | B2 * | 5/2022 | Wang | A63B 21/4035 |
| 11,491,361 | B2 * | 11/2022 | Flick | A63B 21/075 |
| 12,029,935 | B2 * | 7/2024 | Smith | A63B 21/072 |
| 2007/0022106 | A1 | 1/2007 | Brandt et al. | |
| 2018/0117387 | A1 * | 5/2018 | Wang | A63B 21/072 |
| 2023/0030139 | A1 | 2/2023 | Flick et al. | |

FOREIGN PATENT DOCUMENTS

| | | | |
|---|---|---|---|
| CN | 107773908 | A | 3/2018 |
| CN | 214913049 | U | 11/2021 |
| CN | 218516050 | U | 2/2023 |

* cited by examiner

*Primary Examiner* — Joshua Lee

(57) ABSTRACT

Disclosed herein is a kettlebell, including vertically stacked counterweights and a lifting base, wherein two opposite sides of each of the counterweights are provided with hitching lips and inserting openings penetrating through upper and lower surfaces of the counterweight, each of the counterweights is provided with sliding grooves below the hitching lips, the lifting base is internally provided with an adjusting assembly, the adjusting assembly includes first load-bearing blocks and second load-bearing blocks respectively arranged from top to bottom and corresponding to the hitching lips in number, and the first load-bearing blocks and the second load-bearing blocks can sequentially penetrate through the corresponding inserting openings on the layers from top to bottom and horizontally move into the corresponding sliding grooves to be hitched to the counterweights.

11 Claims, 14 Drawing Sheets

B

KETTLEBELL

TECHNICAL FIELD

The present invention relates to fitness equipment, in particular to a kettlebell.

BACKGROUND

As widely used fitness equipment, kettlebells can meet the needs of fitness enthusiasts. At different training stages, the fitness enthusiasts need to purchase a plurality of kettlebells having different weights, the purchase cost is high, and a large space is occupied. The usage weights of some detachable kettlebells can be adjusted by detaching counterweights on the kettlebells, but the operation and switching process is relatively inconvenient, and injuries caused by crushing due to falling occur easily, which cause certain potential safety hazards to users.

SUMMARY

The present invention aims to provide a kettlebell, which can achieve adjustment of various weights, has a convenient and safe adjustment process, and can meet different training needs of users.

To achieve the above purposes, the present invention provides the following technical solution:

a kettlebell comprises: a plurality of counterweights placed in a vertically stacked manner, wherein two opposite side edges of each of the counterweights are provided with hitching lips, which protrude outwards and are centrosymmetric relative to the center point of an upper surface of the counterweight, and inserting openings, which penetrate through upper and lower surfaces of the counterweight and are centrosymmetric relative to the center point of the upper surface of the counterweight, each of the counterweights is provided with sliding grooves below the hitching lips, and each of the inserting openings is in communication with the sliding groove formed at the bottom of the corresponding hitching lip of the corresponding counterweight; and the widths of the inserting openings on two sides of the counterweights from top to bottom are sequentially increased towards the hitching lips, and correspondingly, the lengths of the hitching lips from top to bottom are sequentially reduced; and a lifting base, wherein the lifting base is internally provided with an adjusting assembly, the adjusting assembly comprises a plurality of first load-bearing blocks and a plurality of second load-bearing blocks corresponding to the first load-bearing blocks in number and position, the first load-bearing blocks and the second load-bearing blocks are respectively arranged on the two opposite sides of the counterweights, when the first load-bearing block on each layer and the second load-bearing block on each layer sequentially and respectively penetrate through the corresponding inserting openings of the counterweight on the layer from top to bottom and horizontally move into the sliding grooves below the corresponding hitching lips, the first load-bearing block and the second load-bearing block on each layer can be correspondingly hitched to the corresponding counterweight, and when the first load-bearing blocks and the second load-bearing blocks horizontally move to the corresponding inserting openings, hitching to the counterweights on the corresponding layers is released.

Further, the adjusting assembly further comprises a first adjusting member, a second adjusting member and gears; the plurality of first load-bearing blocks are arranged at the lower end of the first adjusting member, and the plurality of second load-bearing blocks are arranged at the lower end of the second adjusting member; and a driving rack is arranged at the upper end of the first adjusting member, a driven rack matching with the driving rack in shape and size is arranged at the upper end of the second adjusting member, and the driving rack and the driven rack are engaged with each other by means of the gears and can realize synchronous equidistant transmission.

Further, the first adjusting member comprises a first transverse plate and a first vertical plate, and one end of the first transverse plate is perpendicularly mounted at one end of the first vertical plate, so that the first transverse plate and the first vertical plate are combined to form an inverted L-shape; the driving rack is arranged at a free end of the first transverse plate, the first load-bearing blocks are perpendicularly arranged on a plate surface of the first vertical plate, and the first load-bearing blocks and the first transverse plate are located on the plate surface of the same side of the first vertical plate; the second adjusting member comprises a second transverse plate and a second vertical plate, and one end of the second transverse plate is perpendicularly mounted at one end of the second vertical plate, so that the second transverse plate and the second vertical plate are combined to form an inverted L-shape; and the driven rack is arranged at a free end of the second transverse plate, the second load-bearing blocks are perpendicularly arranged on a plate surface of the second vertical plate, and the second load-bearing blocks and the second transverse plate are located on the plate surface of the same side of the second vertical plate.

Further, a locking strip is arranged at the lower end of the adjusting assembly, a locking block is arranged at the position of the lifting base corresponding to the locking strip, the locking block can slide up and down in a limited manner inside the lifting base, the locking strip is provided with a plurality of locking grooves in a movement direction of the adjusting assembly, a clamping section is arranged at the position of the locking block corresponding to the locking grooves, the adjusting assembly cannot move when the clamping section is located inside one of the locking grooves, an unlocking groove is formed below the clamping section, when the locking block moves upwards to enable the unlocking groove to correspond to one of the locking grooves, the locking strip is unlocked, and at this moment, the adjusting assembly can move.

Further, a mounting groove is formed in the position of the lower end of the interior of the lifting base corresponding to the locking strip and is configured to mount the locking block, the locking block can move up and down inside the mounting groove, a locking block limiting plate is arranged above the mounting groove, a spring is further mounted at the top of the locking block, one end of the spring is fixedly connected to the locking block, and the other end of the spring abuts against the locking block limiting plate.

Further, the kettlebell further comprises a base configured to place the counterweights and the lifting base, wherein an abutting column is arranged at the position of an upper surface of the base corresponding to the mounting groove, and when the lifting base is placed on the base, the lower end of the locking block inside the mounting groove of the lifting base abuts against the abutting column.

Further, the lifting base comprises an upper shell, a main frame is mounted inside the upper shell, and a lower shell is arranged at the lower end of the upper shell; the bottom of the main frame is provided with an opening, and the main frame is internally provided with an accommodating space;

the lower shell comprises a limiting cover having a downward opening and configured to cover the stacked counterweights, third sliding grooves are formed at the positions of side walls of two sides of the limiting cover corresponding to lower sides of the hitching lips of each of the counterweights respectively, and the third sliding grooves are in communication with the interior of the limiting cover; and the limiting cover of the lower shell enters the accommodating space inside the main frame via the opening at the lower end of the main frame and is fixedly connected to the main frame.

Further, the main frame comprises a top plate, an annular lower frame is arranged below the top plate, a plate surface of the top plate is perpendicular to an opening direction of the lower frame, connecting metal sheets are oppositely arranged on side edges of two sides of the top plate, the upper end of each of the connecting metal sheets is fixedly connected to the corresponding side edge of the top plate, and the lower ends of the two connecting metal sheets are fixedly connected to an outer ring edge of the lower frame respectively, so that the accommodating space enclosed by the top plate, the lower frame and the two connecting metal sheets is formed in the middle of the main frame.

Further, the first adjusting member and the second adjusting member are slidably connected to the top of the main frame respectively, the gears are rotatably connected to the top of the main frame, and when the first adjusting member and the second adjusting member are mounted on the main frame, the first load-bearing blocks and the second load-bearing blocks can respectively pass through the corresponding third sliding grooves and move in the third sliding grooves to be hitched to the hitching lips.

Further, at least two first limiting grooves are formed in the bottom of each of the counterweights, except for the topmost counterweight, the same number of first limiting protrusions are arranged at the positions of the top of each of the counterweights corresponding to the first limiting grooves, and every two adjacent counterweights are stacked in order by means of the first limiting grooves and the first limiting protrusions.

Further, a ball is arranged on the first adjusting member, a plurality of positioning holes are formed at the position inside the lifting base corresponding to the mounting position of the ball, and the hole diameter of the positioning holes is smaller than the ball diameter of the ball; and a connecting line of the centers of the plurality of positioning holes is parallel with a movement direction of the first adjusting member, the spacing distance between the centers of every two adjacent positioning holes is D, and the ball rolls inside the plurality of positioning holes and on the connecting line thereof. Each of the positioning holes corresponds to a weight gear, and a user can adjust the gear accurately by means of the sound generated between the ball and the positioning holes and the hand feel when adjusting the weight. It can be seen from the analysis that the present invention discloses the kettlebell, the hitching lips and the inserting openings are provided on the two sides of each counterweight, the inserting openings of the counterweights have the different widths, the adjusting assembly is arranged in the lifting base, the plurality of first load-bearing blocks and the plurality of second load-bearing blocks corresponding to the hitching lips are respectively arranged at the lower ends of the two sides of the adjusting assembly, and different numbers of the counterweights are hitched by means of moving the first load-bearing blocks and the second load-bearing blocks on the adjusting assembly, thereby adjusting the weight.

The adjusting assembly comprises the first adjusting member and the second adjusting member, the driving rack and the driven rack which are identical in size are respectively arranged at the ends of the first adjusting member and the second adjusting member, the driving rack and the driven rack are engaged with each other by means of the gears for transmission, and when the first adjusting member is moved, the first adjusting member and the second adjusting member drive the first load-bearing blocks and the second load-bearing blocks to move synchronously, thereby adjusting the weight.

The locking strip is arranged at the lower end of the adjusting assembly, the locking block is arranged at the position of the lower shell corresponding to the locking strip, the locking block can slide up and down in the limited manner inside the lower shell, the locking strip is provided with the plurality of locking grooves in the movement direction of the adjusting assembly, the clamping section is arranged at the position of the locking block corresponding to the locking grooves, the adjusting assembly cannot be adjusted when the clamping section is located inside one of the locking grooves, the unlocking groove is formed below the clamping section, when the locking block moves upwards to enable the unlocking groove to correspond to one of the locking grooves, the locking strip is unlocked, that is, the adjusting assembly can be adjusted, and a locking assembly provided with the locking strip and the locking block can facilitate control on the movement of the adjusting assembly, thereby preventing falling of the counterweights due to unintended touches when the adjustment is not needed.

The widths of the inserting openings of the plurality of counterweights from top to bottom are sequentially increased by the distance D, the lengths of the hitching lips are sequentially reduced by the distance D, correspondingly, the plurality of positioning holes are formed below the first adjusting member, the spacing distance between every two adjacent positioning holes is D, each of the positioning holes corresponds to a weight gear, the ball matching with the positioning holes is arranged below the first adjusting member, and the user can adjust the gear accurately by means of the sound generated between the ball and the positioning holes and the hand feel when adjusting the weight.

BRIEF DESCRIPTION OF THE DRAWINGS

Drawings constituting a portion of the present application are used for providing a further understanding to the present invention; and schematic embodiments of the present invention and descriptions thereof are intended to explain the present invention, and should not be construed to unduly limit this invention. In the drawings.

Figure 1:
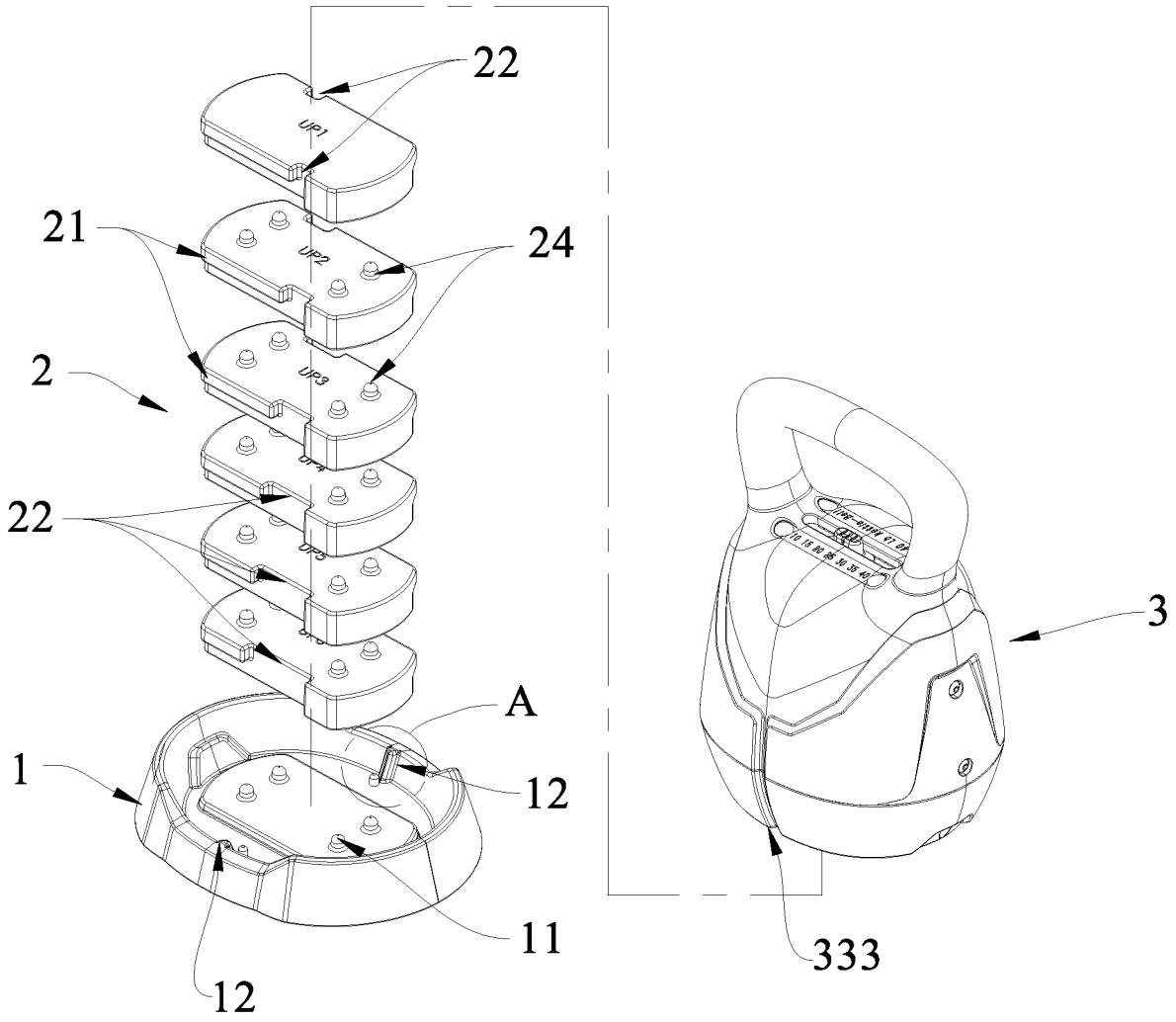
FIG. 1 is a structural exploded view of an embodiment of a kettlebell.
Figure 2:
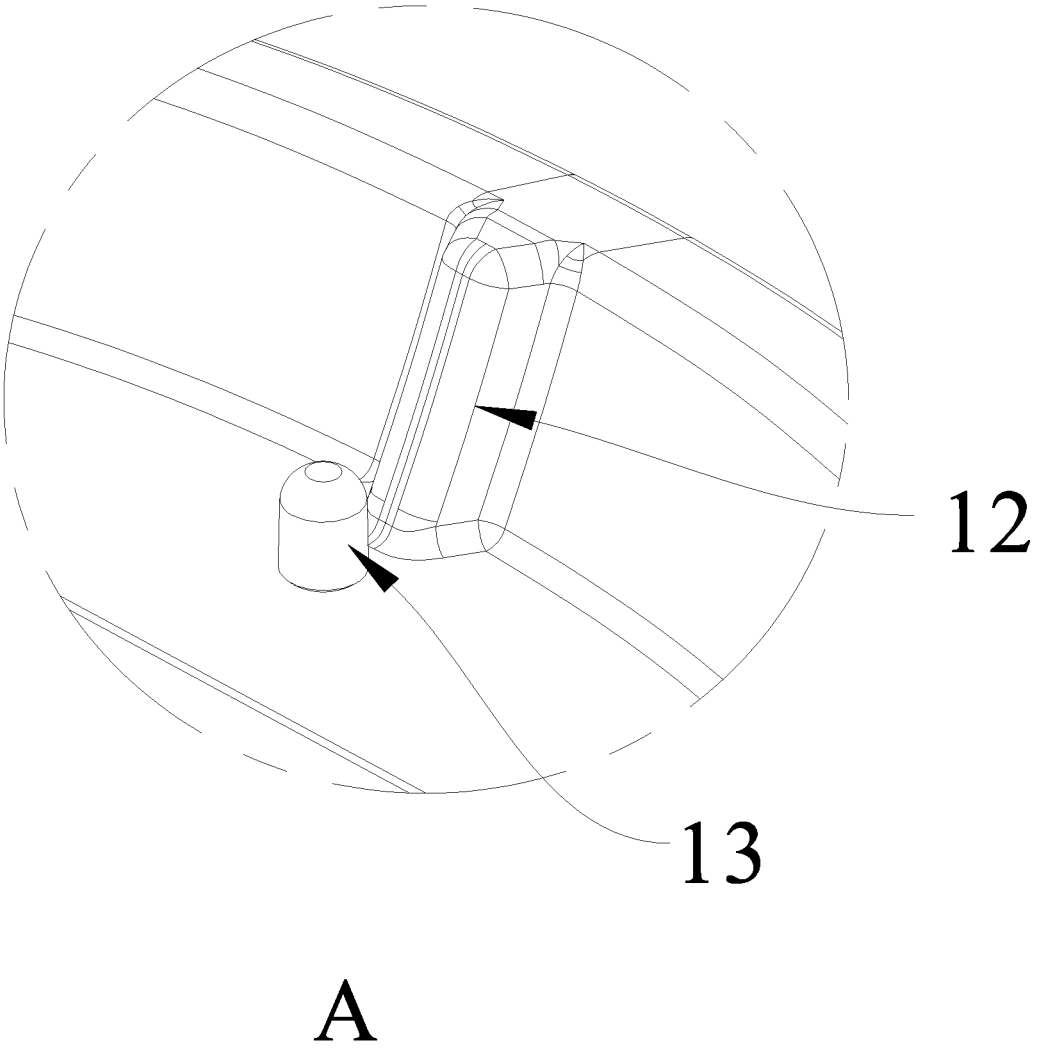
FIG. 2 is a partial enlarged structure diagram at A in FIG. 1.
Figure 3:
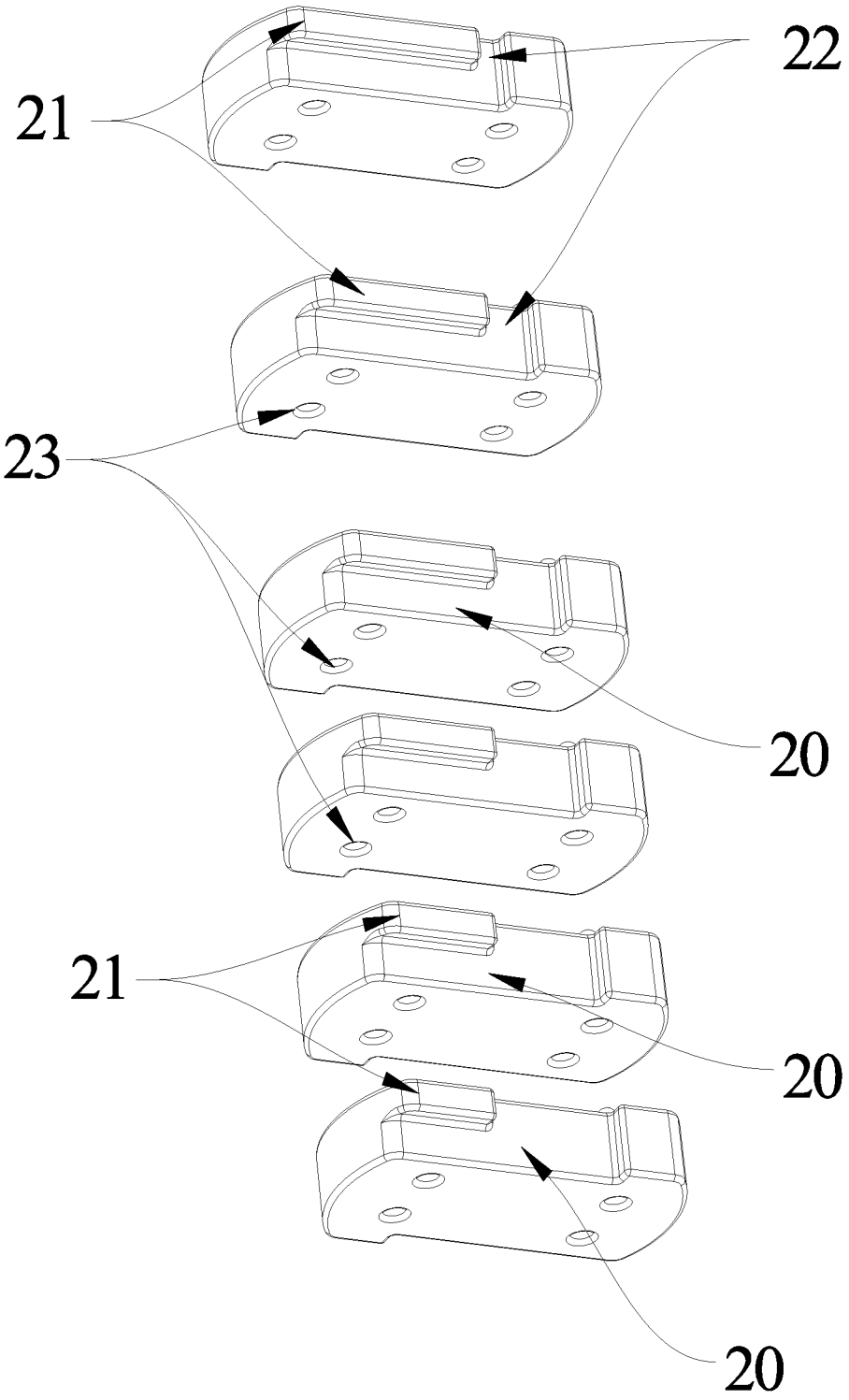
FIG. 3 is a bottom structure diagram of a plurality of counterweights of the embodiment of the kettlebell.
Figure 4:
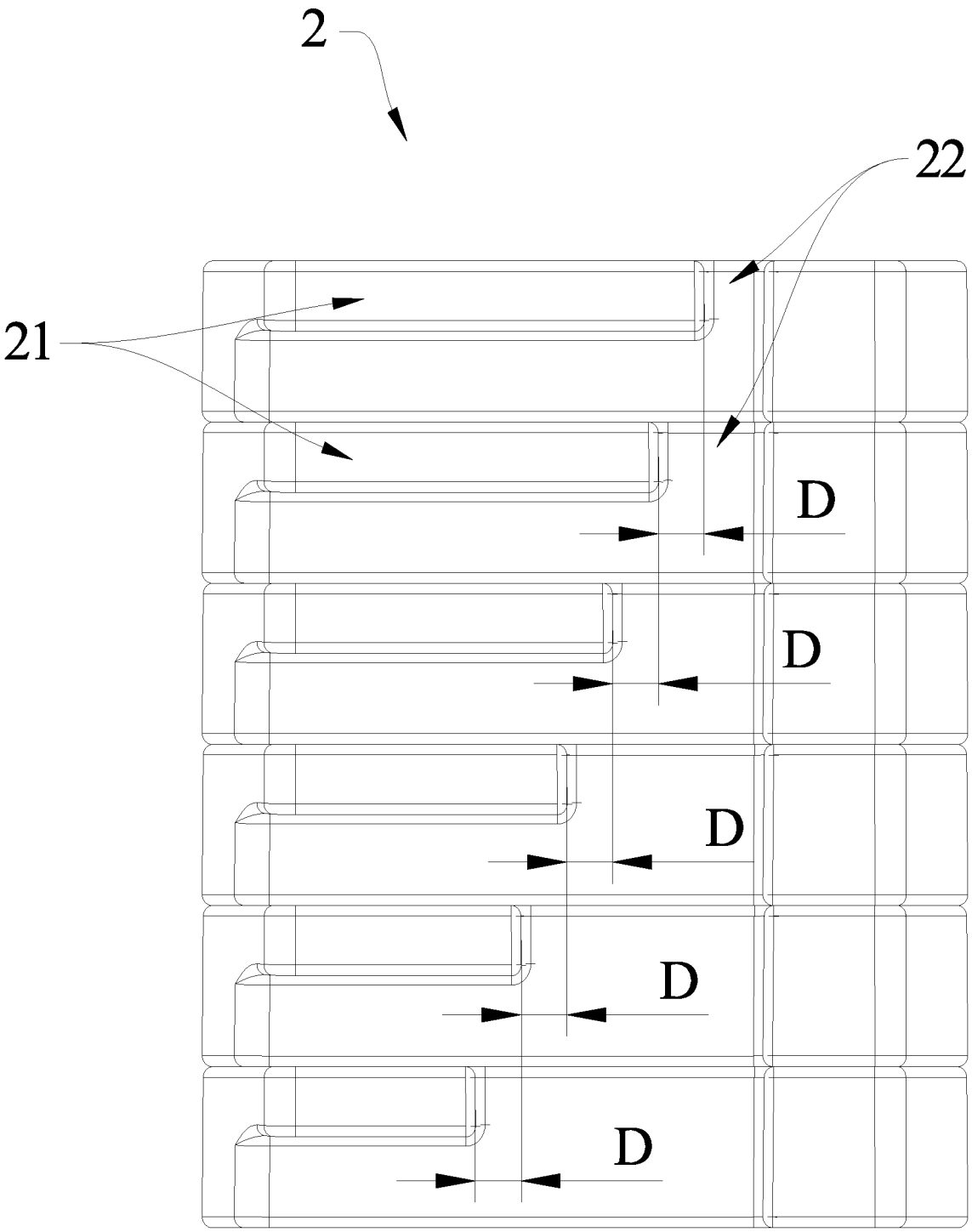
FIG. 4 is a schematic diagram of size changes of hitching lips and inserting openings of the plurality of counterweights of the embodiment of the kettlebell.

Description of reference numerals: 1-base; 11—second limiting protrusion; 12—limiting strip; 13—abutting column; 2—counterweight; 20—L-shaped groove; 21—hitching lip; 22—inserting opening; 23—first limiting groove; 24—first limiting protrusion; 25—transverse groove; 26—vertical groove; 3—lifting base; 30—upper shell; 301—fourth sliding groove; 302—scale label; 31—grip; 311—grip tube; 32—main frame; 321—top plate; 322—lower frame; 323—connecting metal sheet; 324—first sliding groove; 325—second sliding groove; 326—positioning hole; 327—first gear mounting hole; 328—locking block limiting plate; 33—lower shell; 330—lower shell outer edge; 331—limiting cover; 332—third sliding groove; 333—second limiting groove; 334—mounting groove; 335—through hole; 34—first adjusting member; 340—first transverse plate; 341—driving rack; 342—first vertical plate; 343—first load-bearing block; 344—first limiting key; 345—ball; 35—second adjusting member; 350—second transverse plate; 351—driven rack; 352—second vertical plate; 353—second load-bearing block; 354—second limiting key; 36—gear; 37—adjusting knob; 38—locking strip; 381—locking groove; 39—blocking sheet; 391—second gear mounting hole; 392—adjusting knob sliding groove; 40—locking block; 400—clamping section; 401—unlocking groove; 402—spring; and 403—abutting end.

DETAILED DESCRIPTION OF THE EMBODIMENTS

The present invention is described in detail below with reference to the accompanying drawings and embodiments. Each example is provided to explain the present invention instead of limiting the present invention. In fact, those skilled in the art will know that modifications and variations may be made in the present invention without departing from the scope or spirit of the present invention. For example, features shown or described as one part of one embodiment may be applied to another embodiment to generate yet another embodiment. Therefore, it is expected that the present invention includes such modifications and variations that fall within the scope of the appended claims and equivalents thereof.

In the descriptions of the present invention, the orientations or positional relationships indicated by the terms "longitudinal", "transverse", "upper", "lower", "front", "rear", "left", "right", "vertical", "horizontal", "top", "bottom" and the like are orientations or positional relationships based on the drawings, are only for the purpose of facilitating describing of the present invention, and do not indicate that the present invention must be constructed and operated in the specific orientations. Therefore, they cannot be understood as limitations on the present invention. The terms "connection", "connecting" and "arrangement" used in the present invention should be understood in a broad sense, for example, the connection may be fixed connection, and may also be detachable connection; the connection may be direct connection, and may also be indirect connection by means of intermediate components; the connection may be wired electrical connection and wireless electrical connection, and may also be wireless communication signal connection; and for those of ordinary skill in the art, the specific meanings of the above-mentioned terms can be understood according to the specific situations.

The accompanying drawings show one or a plurality of examples of the present invention. Numeral and letter marks are used in the detailed descriptions to refer to the features in the accompanying drawings. Similar or like marks in the accompanying drawings and the descriptions have been used to refer to similar or like parts of the present invention. As used herein, the terms "first", "second", "third" and the like are used interchangeably so as to distinguish one component from another, and are not intended to indicate the positions or the importance of the individual components.

As shown in FIGS. 1-13, according to an embodiment of the present invention, a kettlebell is provided and includes a base 1, wherein an accommodating space is formed on an upper surface of the base 1, and six counterweights 2 and a lifting base 3 for fixing and lifting the counterweights 2 are vertically stacked inside the accommodating space.

Two opposite side walls of each of the counterweights 2 are provided with L-shaped grooves 20, a groove corresponding to one edge of each of the L-shaped grooves 20 forms an open groove at the junction of a bottom surface and a side surface of the counterweight 2, then hitching lips 21 protruding outwards are formed at the positions of two side edges of the counterweight 2 that are located above the L-shaped grooves 20, a groove corresponding to the other edge of each of the L-shaped grooves 20 forms an inserting opening 22 at a top surface of the counterweight 2, and the inserting openings 22 penetrate through the top surface and the bottom surface of the counterweight 2. The six counterweights 2 are sequentially stacked together from top to bottom, the widths of the inserting openings 22 of the counterweights 2 are sequentially increased by a distance D, and correspondingly, the lengths of the hitching lips 21 are sequentially reduced by the distance D. The L-shaped grooves 20 on the two side walls of each of the counterweights 2 are centrosymmetric relative to the center point of the upper surface of the counterweight 2. The lifting base 3 is internally provided with an adjusting assembly, the adjusting assembly includes a plurality of first load-bearing blocks 343 and second load-bearing blocks 353 which are respectively arranged from top to bottom and correspond to the hitching lips 21 on the two sides of the counterweights 2, the first load-bearing blocks 343 and the second load-bearing blocks 353 are respectively inserted into the corresponding L-shaped grooves 20 from the corresponding inserting openings 22, and when the first load-bearing blocks 343 and the second load-bearing blocks 353 respectively move towards the corresponding hitching lips 21, one hitched counterweight 2 is added to the adjusting assembly every time said blocks move by the distance D.

Further, the two opposite side walls of each of the counterweights 2 may also be provided with T-shaped grooves, transverse grooves 25 are formed in the middles of the side surfaces of the counterweight 2, the side surfaces, the top surface and the bottom surface of the counterweight 2 are put through to form vertical grooves 26, the transverse grooves 25 are perpendicular to and in communication with the vertical grooves 26, then the hitching lips are formed above the transverse grooves 25 of the counterweight 2, and the vertical grooves 26 of the counterweight 2 form the inserting openings.

The lifting base 3 includes an upper shell 30, wherein a grip 31 is arranged at the top end of the upper shell 30 and is configured to be held by a user for training; and a main frame 32 is mounted inside the upper shell 30, the grip 31 internally includes a grip tube 311, and a connecting end of the grip tube 311 is fixedly connected to the top of the main frame 32. A lower shell 33 is arranged at the lower end of the upper shell 30, and the lower shell 33 is fixedly connected to the main frame 32.

Figure 11:
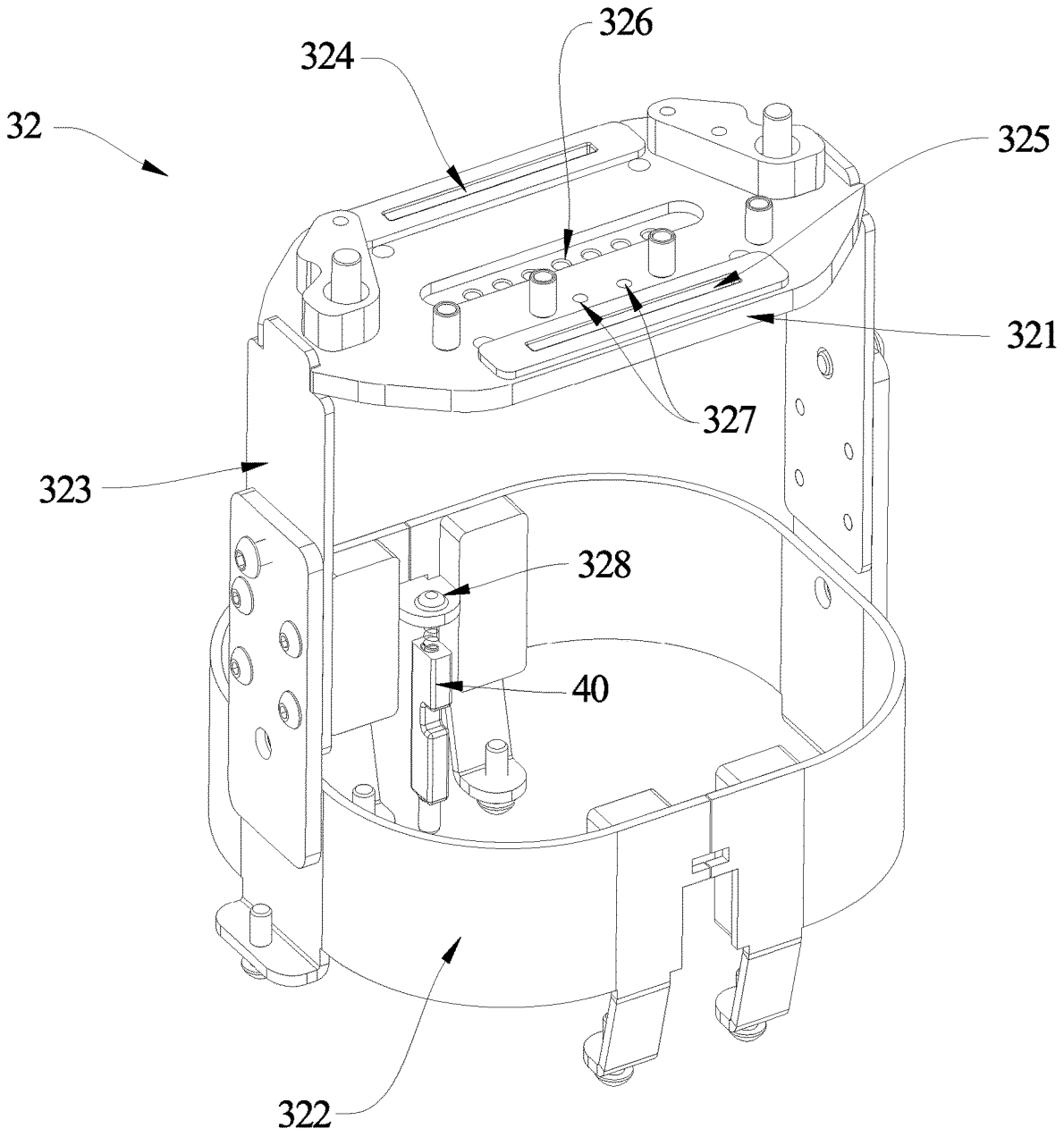
FIG. 11 is a structure diagram of a main frame inside the lifting base of the embodiment of the kettlebell.

As shown in FIG. 11, the main frame 32 includes a top plate 321, an annular lower frame 322 is arranged below the top plate 321, a plate surface of the top plate 321 is perpendicular to an opening direction of the lower frame 322, connecting metal sheets 323 are oppositely arranged on side edges of two sides of the top plate 321, the upper end of each of the connecting metal sheets 323 is fixedly connected to the corresponding side edge of the top plate 321, and the lower ends of the two connecting metal sheets 323 are fixedly connected to an outer ring edge of the lower frame 322 respectively, so that the accommodating space enclosed by the top plate 321, the lower frame 322 and the two connecting metal sheets 323 is formed in the middle of the main frame 32.

Figure 5:
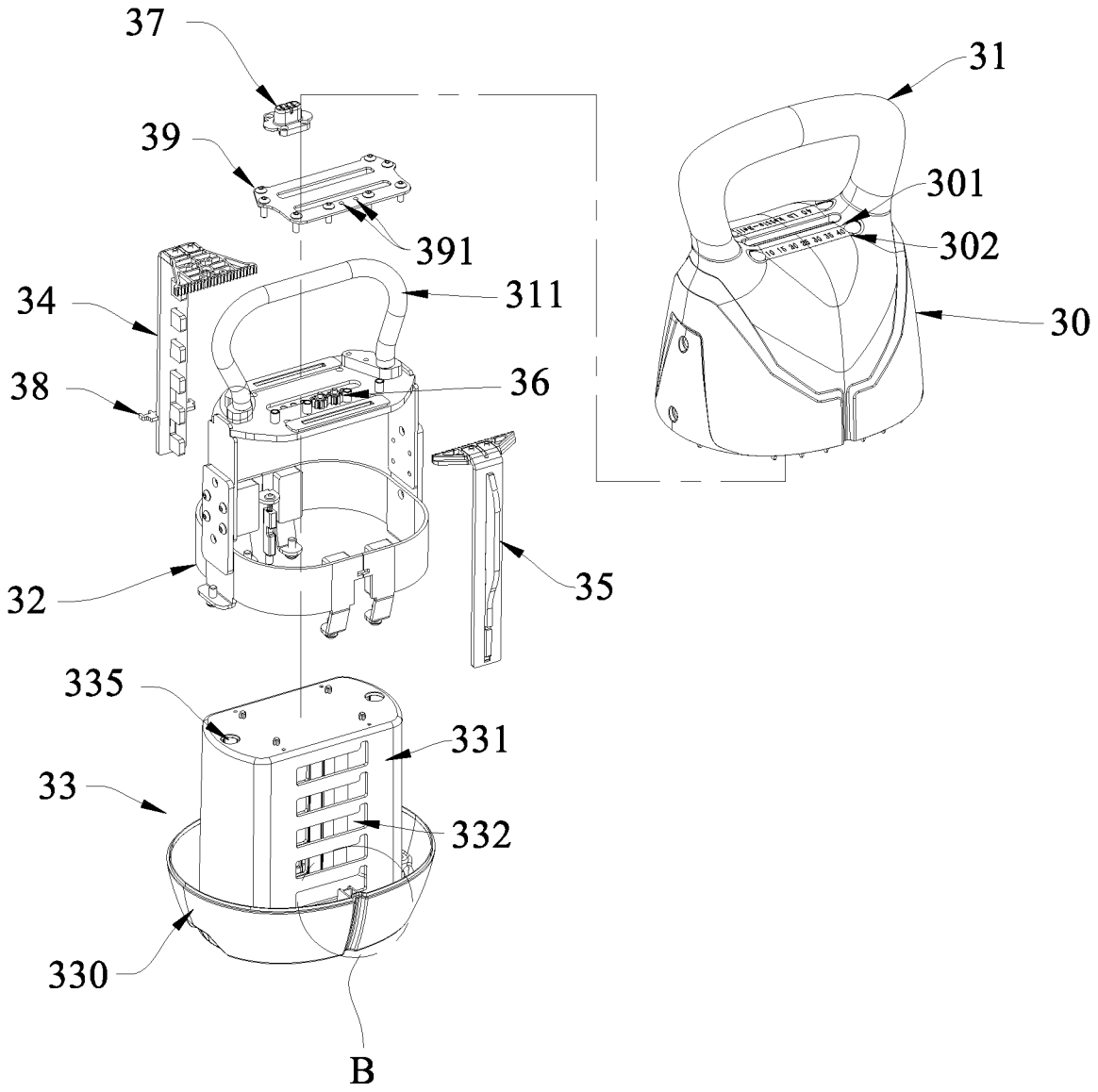
FIG. 5 is a structural exploded view of a lifting base of the embodiment of the kettlebell.
Figure 6:
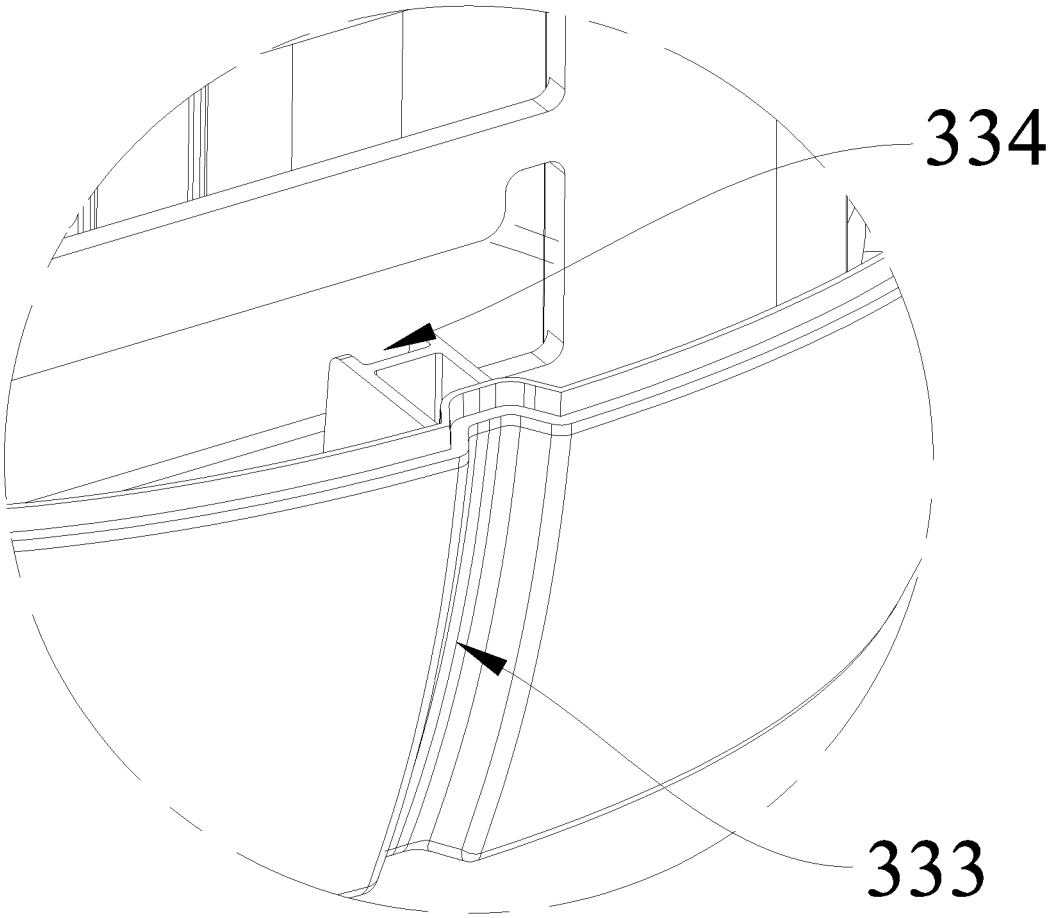
FIG. 6 is a partial enlarged structure diagram at B in FIG. 5.
Figure 7:
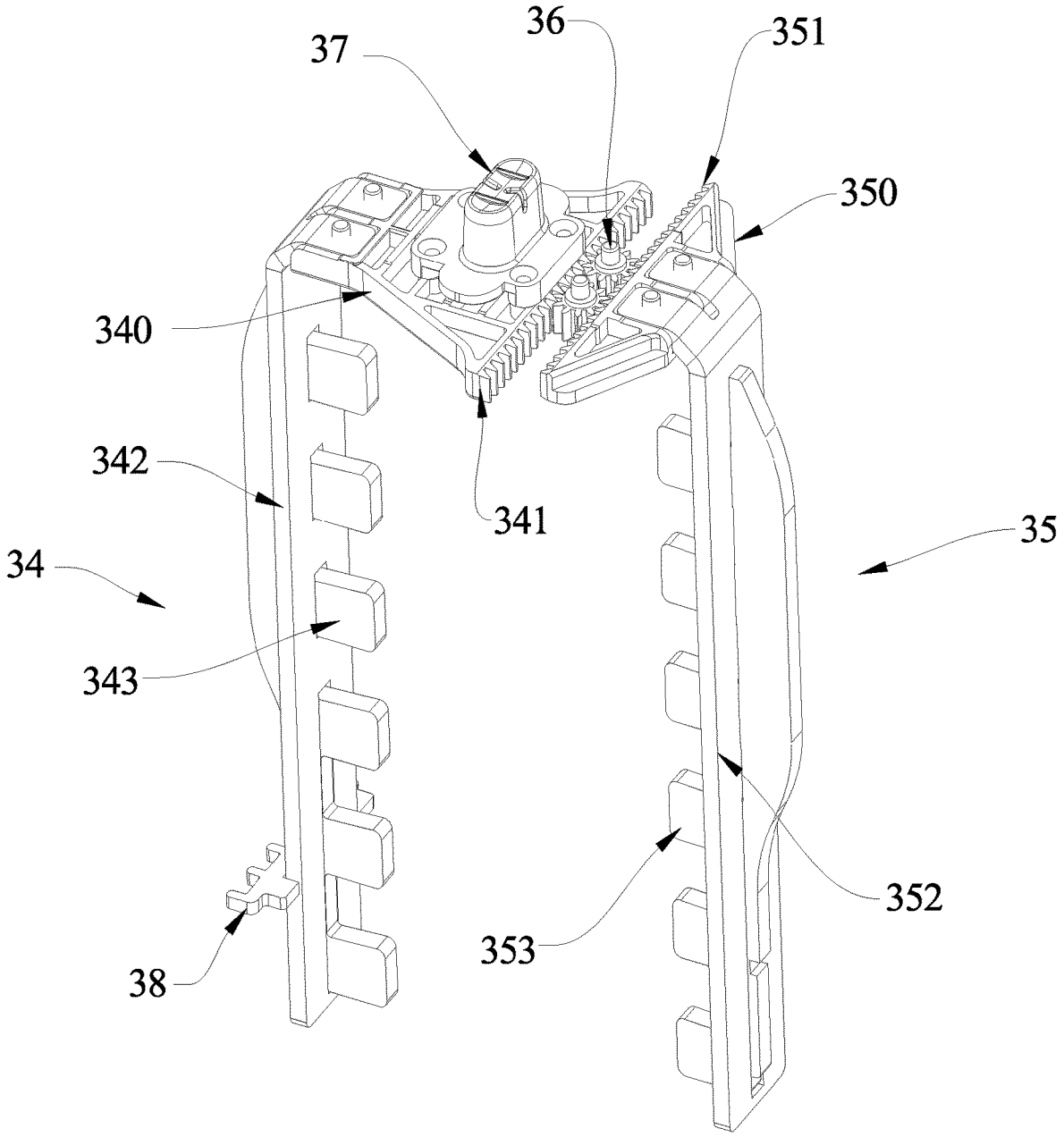
FIG. 7 is a structure diagram of an adjusting assembly of the embodiment of the kettlebell.
Figure 8:
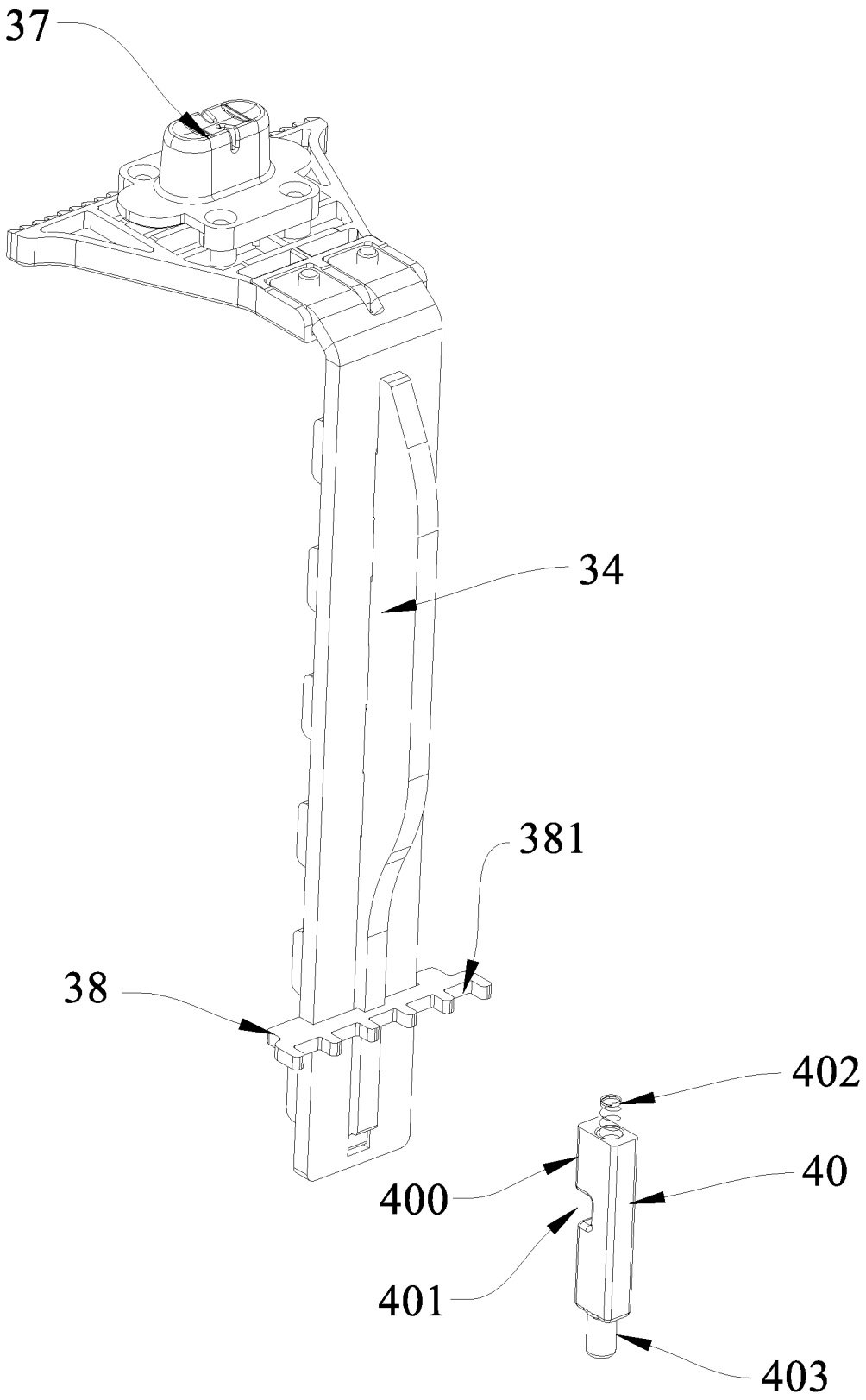
FIG. 8 is a structure diagram of one side of a first adjusting member of the embodiment of the kettlebell.
Figure 9:
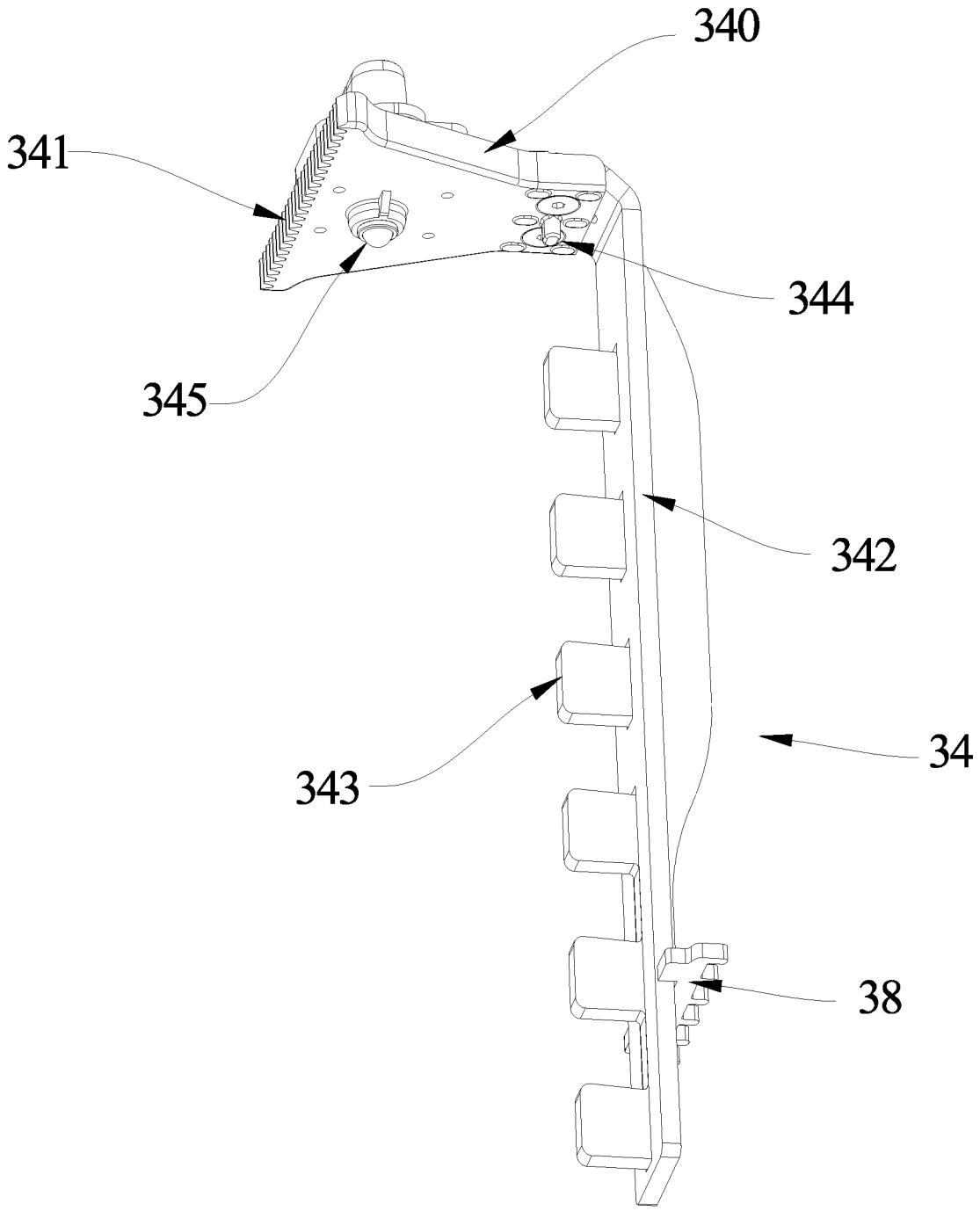
FIG. 9 is a structure diagram of the other side of the first adjusting member of the embodiment of the kettlebell.
Figure 10:
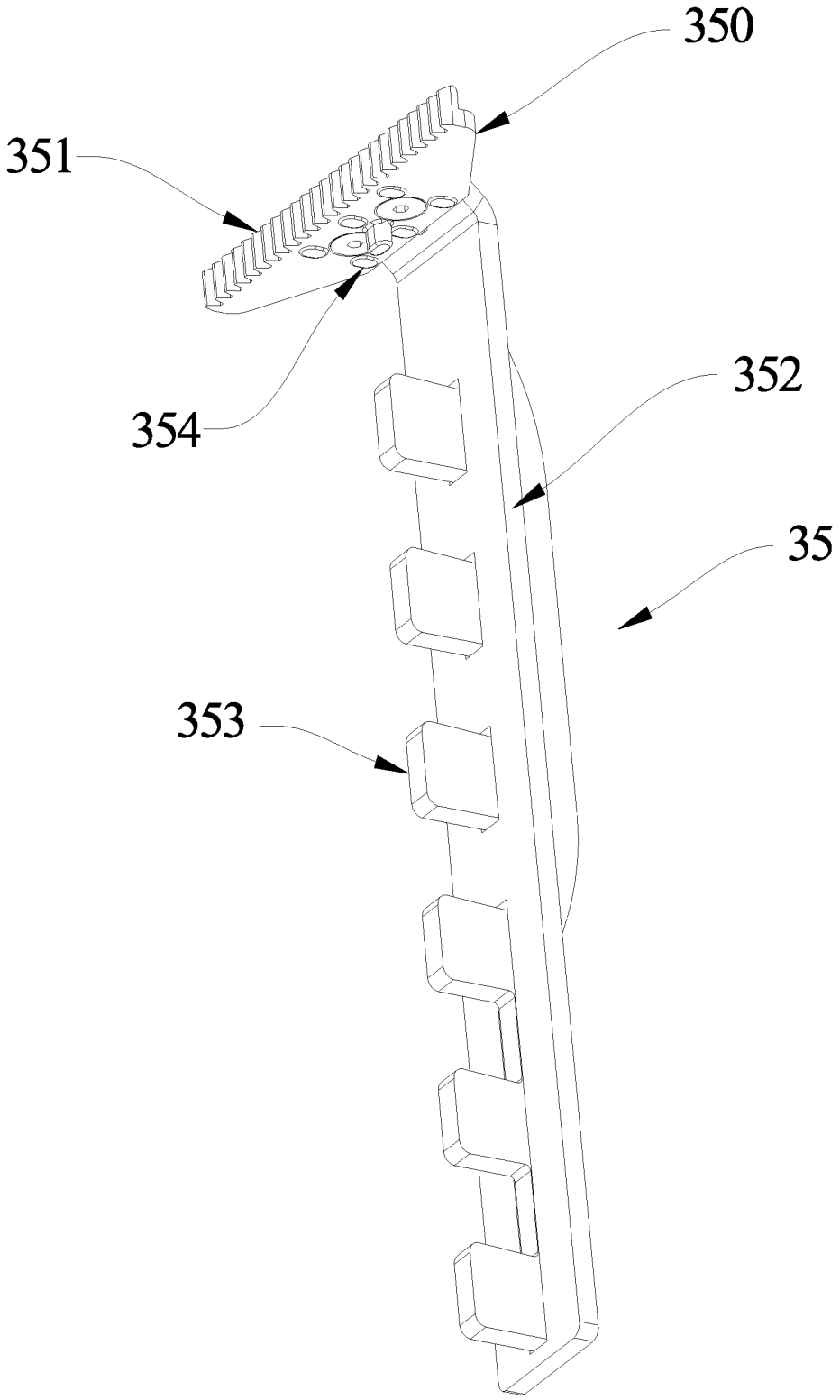
FIG. 10 is a structure diagram of a second adjusting member of the embodiment of the kettlebell.
Figure 12:
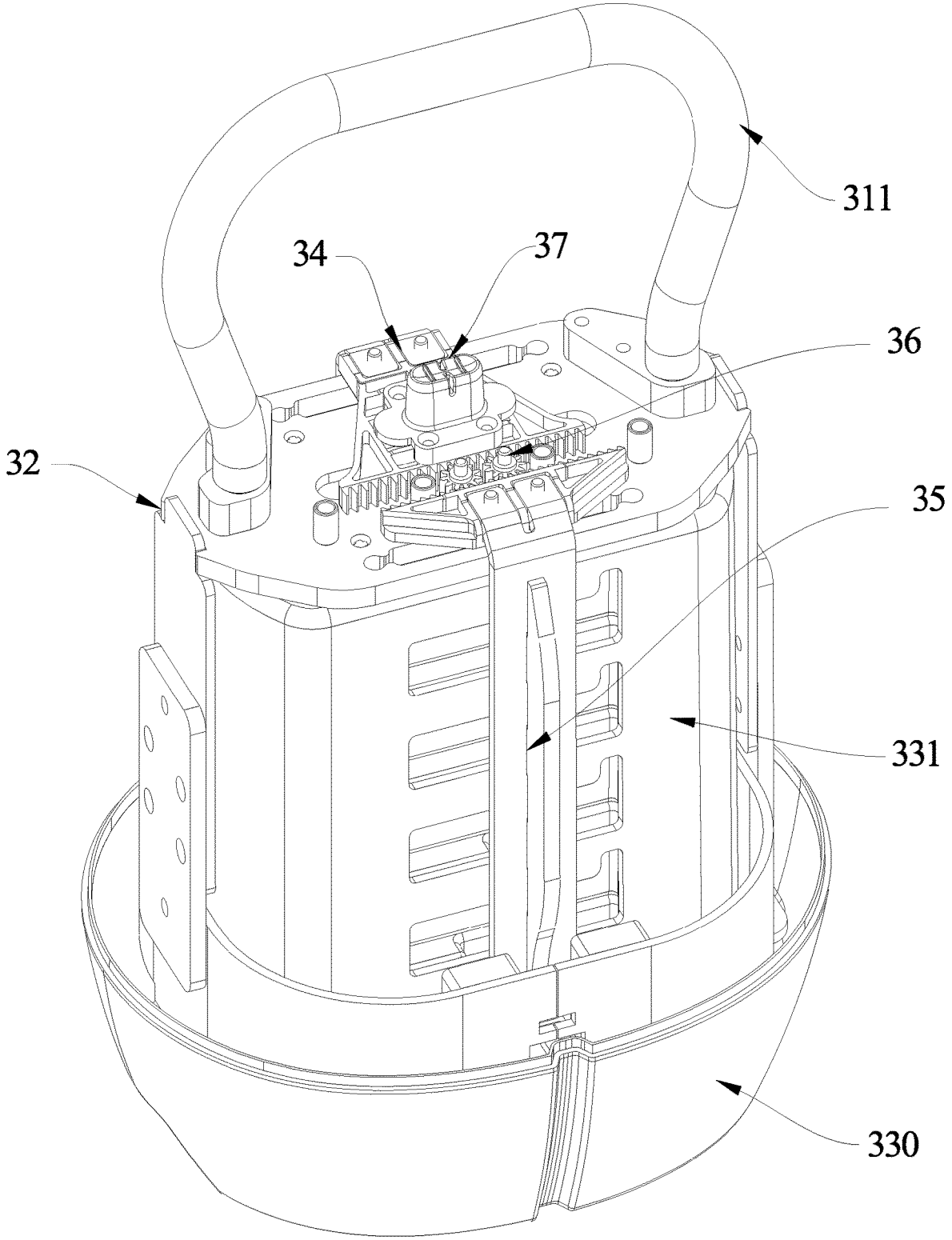
FIG. 12 is a structure diagram for mounting of the main frame, a lower shell and the adjusting assembly of the embodiment of the kettlebell.
Figure 13:
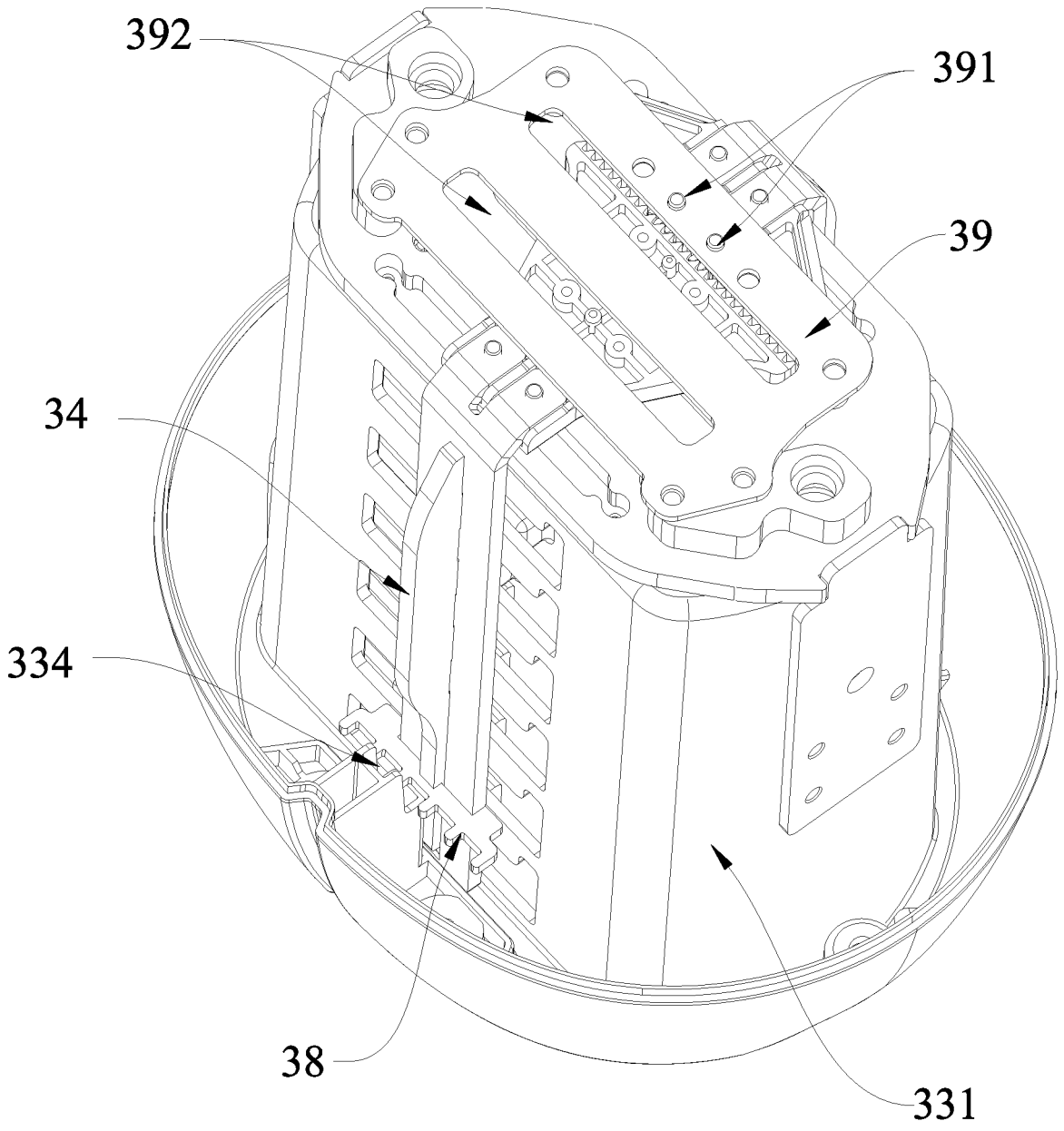
FIG. 13 is a structure diagram for mounting of a blocking sheet on the main frame of the embodiment of the kettlebell.
Figure 14:
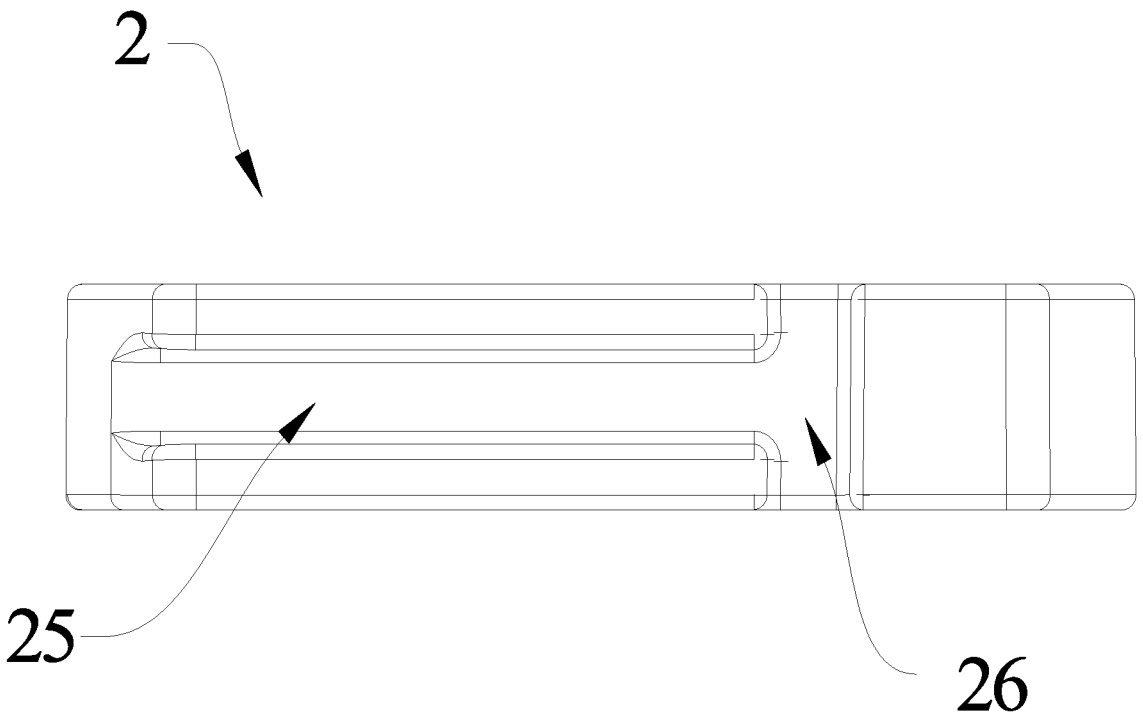
FIG. 14 is a structure diagram of a T-shaped groove on a side surface of the counterweight of the embodiment of the kettlebell.

As shown in FIG. 5, the lower shell 33 includes a lower shell outer edge 330, the lower shell outer edge 330 is a shell having openings at both upper and lower ends, and the caliber of the opening at the upper end is greater than that of the opening at the lower end. The lower shell 33 further includes a limiting cover 331 having a downward opening, and the opening at the lower end of the limiting cover 331 is connected to the opening at the lower end of the lower shell 33 such that the lower shell outer edge 330 is integrated with the limiting cover 331. The limiting cover 331 of the lower shell 33 enters the accommodating space inside the main frame 32 via the opening of the lower frame 322 at the lower end of the main frame 32, then the top surface of the limiting cover 331 is fixedly connected to the top plate 321, at the same time, the lower frame 322 of the main frame 32 is arranged between the limiting cover 331 and the lower shell outer edge 330, and the lower frame 322 is fixedly connected to the lower shell outer edge 330. FIG. 12 is a structure diagram of the main frame 32 and the lower shell 33 after fixed connection.

The adjusting assembly inside the lifting base 3 includes a first adjusting member 34, a second adjusting member 35 and two gears 36, and the first adjusting member 34, the second adjusting member 35 and the two gears 36 form a gear-rack transmission mechanism. Specifically, the first adjusting member 34 includes a first transverse plate 340 and a first vertical plate 342, and one end of the first transverse plate 340 is perpendicularly mounted at one end of the first vertical plate 342, so that the first transverse plate 340 and the first vertical plate 342 are combined to form an inverted L-shape. A driving rack 341 is arranged at a free end of the first transverse plate 340, the six first load-bearing blocks 343 are perpendicularly arranged on a plate surface of the first vertical plate 342, and the first load-bearing blocks 343 and the first transverse plate 340 are located on the plate surface of the same side of the first vertical plate 342. The second adjusting member 35 includes a second transverse plate 350 and a second vertical plate 352, and one end of the second transverse plate 350 is perpendicularly mounted at one end of the second vertical plate 352, so that the second transverse plate 350 and the second vertical plate 352 are combined to form an inverted L-shape. A driven rack 351 is arranged at a free end of the second transverse plate 350, the six second load-bearing blocks 353 are perpendicularly arranged on a plate surface of the second vertical plate 352, and the second load-bearing blocks 353 and the second transverse plate 350 are located on the plate surface of the same side of the second vertical plate 352. The driving rack 341 is the same as the driven rack 351 in shape and size. Two first gear mounting holes 327 are formed in the upper surface of the top plate 321, the two gears 36 are respectively mounted in the two first gear mounting holes 327, and rotating shafts of the gears 36 can rotate inside the first gear mounting holes 327. When the driving rack 341 and the driven rack 351 carry out transmission by means of the gears 36, the driving rack 341 and the driven rack 351 have the opposite movement directions and the same movement distances. The first load-bearing blocks 343 on the first adjusting member 34 and the second load-bearing blocks 353 on the second adjusting member 35 respectively enter the corresponding L-shaped grooves 20 from the corresponding inserting openings 22, and are simultaneously and respectively moved below the hitching lips 21 to be hitched to the hitching lips 21. When the adjusting assembly hangs the counterweights 2, the first load-bearing blocks 343 on the first adjusting member 34 and the second load-bearing blocks 353 on the second adjusting member 35 are respectively located below the hitching lips 21 on the two sides of the counterweights 2, and when the adjusting assembly moves upwards, the counterweights 2 are lifted upwards at the same time.

As shown in FIG. 12, the adjusting assembly is mounted on the upper surface of the top plate 321 of the main frame 32, the first adjusting member 34 and the second adjusting member 35 slide on the top plate 321 synchronously in a limited manner, and the two gears 36 are rotatably mounted on the upper surface of the top plate 321. Specifically, a first sliding groove 324 and a second sliding groove 325 which are parallel with each other are respectively formed in the upper surface of the top plate 321, correspondingly, a first limiting key 344 matching with the first sliding groove 324 is arranged on a lower surface of the first transverse plate 340 of the first adjusting member 34, and a second limiting key 354 matching with the second sliding groove 325 is arranged on a lower surface of the second transverse plate 350 of the second adjusting member 35. When the first limiting key 344 and the second limiting key 354 are respectively and correspondingly mounted in the first sliding groove 324 and the second sliding groove 325, the first adjusting member 34 and the second adjusting member 35 can be engaged with the gears 36 for transmission, and when the first adjusting member 34 slides in the first sliding groove 324, the second adjusting member 35 slides in an opposite direction along the second sliding groove 325.

Further, to make the adjustment distance of the adjusting assembly be D each time, six positioning holes 326 are sequentially and linearly formed in the top plate 321 of the main frame 32 at intervals of the distance D, and a connecting line of the centers of the six positioning holes 326 are parallel with lengthwise directions of the first sliding groove 324 and the second sliding groove 325 respectively. Correspondingly, a ball 345 is arranged on the lower surface of the first transverse plate 340 of the first adjusting member 34, the diameter of the ball 345 is greater than the hole diameter of the positioning holes 326, and when the first limiting key 344 of the first adjusting member 34 is located in the first sliding groove 324, the ball 345 is located on the connecting line of the six positioning holes 326. When the first limiting key 344 slides from one end inside the first sliding groove 324 to the other end, the ball 345 sequentially rolls through the six positioning holes 326, and when the ball 345 rolls into the next positioning hole 326 from one positioning hole 326, one hitched counterweight 2 is added to or removed from the adjusting assembly. When the first adjusting member 34 is moved and the ball 345 rolls into another positioning hole 326 from one positioning hole 326, a clicking sound will be produced, and the user can have a corresponding hand feel, so that the user can adjust the gear conveniently and accurately.

In order to facilitate one-to-one correspondence of the positions of the inserting openings 22 of each of the counterweights 2 during placement of the counterweights 2, four first limiting groove 23 are formed in the bottom of each of the counterweights, and correspondingly, except for the topmost counterweight 2, four first limiting protrusions 24 are arranged at the positions of the top of each of the counterweights 2 corresponding to the four first limiting grooves 23. When the first limiting grooves 23 of one counterweight 2 match with the first limiting protrusions 24 of the counterweight 2 below for mounting, the positions of the inserting openings 22 of the upper and lower counterweights 2 are in one-to-one correspondence with each other, and thus the first load-bearing blocks 343 and the second load-bearing blocks 353 pass through the inserting openings 22 conveniently. In addition, every time the first adjusting member 34 moves towards the hitching lips by the distance D, one hitched counterweight 2 is added to the adjusting assembly. On the contrary, every time the first adjusting member 34 moves in the opposite direction of the hitching lips by the distance D, one hitched counterweight 2 is removed from the adjusting assembly. Correspondingly, four second limiting protrusions 11 are arranged in the accommodating space on the upper surface of the base 1, and the second limiting protrusions 11 correspond to the first limiting grooves 23 in position. The counterweights 2 can be stacked on the base 1 conveniently and stably, the lifting base 3 can conveniently cover the counterweights 2 inside, and the counterweights 2 that are not hitched can be prevented from toppling over and falling while convenient hitching is ensured.

Further, in order to ensure the stable fixing during the process that the lifting base 3 lifts the counterweights 2 upwards and to prevent the falling accident, the size of the limiting cover 331 of the lower shell 33 is set such that the shape and size of the accommodating space inside the limiting cover 331 match with the shape and size of the six counterweights 2 stacked together, thus the limiting cover 331 can easily cover the counterweights 2, and the counterweights 2 can be prevented from falling when being lifted. Six third sliding grooves 332 are respectively formed at the positions of each of side walls of two sides of the limiting cover 331 corresponding to lower sides of the hitching lips 21 of the counterweights 2, the third sliding grooves 332 are in communication with the interior of the limiting cover 331, and when the first adjusting member 34 and the second adjusting member 35 are mounted on the top plate 321, the first load-bearing blocks 343 and the second load-bearing blocks 353 can respectively pass through the corresponding third sliding grooves 332 and move inside the third sliding grooves 332 to be hitched to the hitching lips 21.

Further, to stably fix the adjusting assembly on the top plate 321, a blocking sheet 39 is arranged on the top plate 321, and after the blocking sheet 39 limits the adjusting assembly between the top plate 321 and the blocking sheet 39, the blocking sheet 39 is fixedly connected to the upper surface of the top plate 321. Two second gear mounting holes 391 are formed at the positions of the blocking sheet 39 corresponding to the two first gear mounting holes 327, and when the blocking sheet 39 is fixedly connected to the top plate 321, the two ends of the gears 36 are respectively connected in a limited manner by means of the first gear mounting holes 327 and the second gear mounting holes 391. Adjusting knob sliding grooves 392 are formed in the positions of the blocking sheet 39 corresponding to the upper side of the first adjusting member 34, an adjusting knob 37 is arranged above the first adjusting member 34, the bottom of the adjusting knob 37 penetrates through the adjusting knob sliding grooves 392 to be fixedly connected to the first adjusting member 34, and thus the first adjusting member 34 can be conveniently moved above the blocking sheet 39 by means of the adjusting knob 37.

Further, to prevent falling of the counterweights 2 due to movement of the adjusting assembly when the lifting base 3 is lifted upwards, a locking strip 38 is further arranged below the first vertical plate 342 of the first adjusting member 34, five locking grooves 381 are formed in the locking strip 38, and the distance between the center lines of every two adjacent locking grooves 381 is D. Correspondingly, a locking block 40 is arranged on the inner side of the lower frame 322 of the main frame 32, the locking block 40 is provided with a clamping section 400, the width of the clamping section 400 matches with the widths of the locking grooves 381, and when the clamping section 400 is located in one of the locking grooves 381, the locking strip 38 cannot move in the lengthwise direction. An unlocking groove 401 is formed below the clamping section 400 of the locking block 40, and the size of the unlocking groove 401 in the vertical direction matches with the thickness of the locking strip 38, so that the locking strip 38 can pass through the unlocking groove 401 to reciprocate. The locking or unlocking state of the locking strip 38 can be switched when the locking block 40 moves up and down. In the locking state, the clamping section 400 of the locking block 40 is located in one of the locking grooves 381, the movement of the locking strip 38 is limited at this moment, that is, the movement of the first adjusting member 34 is limited, and the weight cannot be adjusted at this moment. When the locking block 40 moves upwards to make the unlocking groove 401 corresponds to the locking strip 38, the locking strip 38 can pass through the unlocking groove 401 to reciprocate, then the first adjusting member 34 is unlimited and can move, and the weight can be adjusted at this moment. Correspondingly, a mounting groove 334 is formed in the lower end of the lower shell 33 and is configured to mount the locking block 40, and the locking block 40 can move up and down inside the mounting groove 334. An abutting end 403 with the cross sectional size reduced is arranged at the bottom end of the locking block 40, correspondingly, a through hole matching with the abutting end 403 is formed in the bottom end of the mounting groove 334, and the abutting end 403 is only allowed to penetrate through the through hole to move up and down. A locking block limiting plate 328 is arranged at the position on the inner side of the lower frame 322 of the main frame 32 corresponding to the mounting groove 334, a spring 402 is further mounted at the top of the locking block 40, one end of the spring 402 is fixedly connected to the locking block 40, and the other end of the spring 402 abuts against the locking block limiting plate 328. Correspondingly, an abutting column 13 is arranged at the position of the upper surface of the base 1 corresponding to the mounting groove 334, when the lifting base 3 is placed on the base 1, the lower end of the locking block 40 inside the mounting groove 334 of the lifting base 3 abuts against the abutting column 13, the locking block 40 moves relatively upwards, the spring 402 is compressed at this moment, the unlocking groove 401 of the locking block 40 corresponds to the locking strip 38, and the first adjusting member 34 can be moved and adjusted at this moment, that is, when the lifting base 3 is placed on the base 1, the weight can be adjusted. When the lifting base 3 is lifted upwards, the contact between the locking block 40 and the abutting column 13 is removed, the locking block 40 moves downwards under the action of the restoring force of the spring 402 at this moment, the clamping section 400 of the locking block 40 is inserted into one of the locking grooves 381 of the locking strip 38, and the first adjusting member 34 cannot be moved at this moment. The locking strip 38, the locking block 40 and the abutting column 13 are arranged to ensure that the counterweights 2 cannot fall during the lifting process of the lifting base 3. When the counterweights 2 are not hitched to the lifting base 3, the locking block 40 is located at one end of the outer side of the locking strip 38. When the locking block 40 moves relatively to the other end of the outer side of the locking strip 38, the movement distance is 6D, and one movement distance D respectively corresponds to one weight adjustment gear. When the lifting base 3 is lifted upwards to leave the base 1, the locking strip 38 matches with the locking block 40 to lock the corresponding weight gear.

Further, in order to facilitate the corresponding of the mounting groove 334 of the lifting base 3 to the abutting column 13 when the lifting base 3 is placed on the base 1, two limiting strips 12 are further arranged on the upper surface of the base 1, and the two limiting strips 12 are arranged oppositely. Correspondingly, two second limiting grooves 333 are formed at the positions of the bottom end of the lifting base 3 corresponding to the two limiting strips 12, and the second limiting grooves 333 match with the limiting strips 12 to facilitate the accurate positioning when the lifting base 3 is placed on the base 1.

Further, a fourth sliding groove 301 is formed at the position above the upper shell 30 of the lifting base 3 corresponding to the mounting position of the adjusting knob 37 on the main frame 32, and when the upper shell 30 is mounted on the main frame 32, the upper end of the adjusting knob 37 extends out of the fourth sliding groove 301 and slides inside the fourth sliding groove 301 to facilitate the adjustment. Scale labels 302 are respectively arranged on two sides of the fourth sliding groove 301, the spacing distance between every two adjacent weight gears on each of the scale labels 302 is D, and each weight gear corresponds to one positioning hole 326 of the adjusting assembly. When the adjusting knob 37 moves by the distance D along the scale labels 302, the six first load-bearing blocks 343 on the first adjusting member 34 move by the distance D along with the first adjusting member 34, and at the same time, the second load-bearing blocks 353 move synchronously by the distance D in the opposite direction along with the second adjusting member 35. Among the vertically stacked counterweights 2, the difference between the lengths of the hitching lips 21 of every two adjacent counterweights 2 is D, and one hitched counterweight 2 can be added or removed when the adjusting knob 37 moves by the distance D, so that the hitching number of the counterweights 2 on the lifting base 3 can be achieved. In addition, the locking strip 38 at the lower end of the first adjusting member 34 moves by the distance D along with the first adjusting member 34, and when the lifting base 3 is removed from the base 1, the corresponding weight gear is locked by means of the locking strip 38 and the locking block 40.

From the above description, it can be seen that the above embodiments of the present invention achieve the following technical effects:

1. the hitching lips 21 and the inserting openings 22 are provided on the two sides of the counterweights 2, the inserting openings 22 and the hitching lips 21 of the counterweights 2 have the different widths, the adjusting assembly is arranged in the lifting base 3, the plurality of first load-bearing blocks 343 and the plurality of second load-bearing blocks 353 corresponding to the hitching lips 21 are respectively arranged at the lower ends of the two sides of the adjusting assembly, and the different numbers of the counterweights 2 are hitched by means of moving the first load-bearing blocks 343 and the second load-bearing blocks 353 on the adjusting assembly, thereby adjusting the weight;
2. the hitching lip 21 and the inserting opening 22 on one side edge of each of the counterweights 2 and the hitching lip 21 and the inserting opening 22 on the other side edge are centrosymmetric relative to the center point of the upper surface of the counterweight 2; the adjusting assembly comprises the first adjusting member 34 and the second adjusting member 35, the driving rack 341 and the driven rack 351 which are identical in size are respectively arranged at the ends of the first adjusting member 34 and the second adjusting member 35, the driving rack 341 and the driven rack 351 are engaged with each other by means of the gears 36 for transmission, and when the first adjusting member 34 is moved, the first adjusting member 34 and the second adjusting member 35 drive the first load-bearing blocks 343 and the second load-bearing blocks 353 to move synchronously in opposite directions by the equal distances, thereby adjusting the weight; the hitching points on the two sides of each of the counterweights 2 are set to be centrosymmetric relative to the center point of the upper surface of the counterweight 2, so that the hitched counterweights 2 can be more stable;
3. the locking strip 38 is arranged at the lower end of the adjusting assembly, the locking block 40 is arranged at the position of the lower shell 33 corresponding to the locking strip 38, the locking block 40 can slide up and down in the limited manner inside the lower shell 33, the locking strip 38 is provided with the plurality of locking grooves 381 in the movement direction of the adjusting assembly, the clamping section 400 is arranged at the position of the locking block 40 corresponding to the locking grooves 381, the adjusting assembly cannot be adjusted when the clamping section 400 is located inside one of the locking grooves 381, the unlocking groove 401 is formed below the clamping section 400, when the locking block 40 moves upwards to enable the unlocking groove 401 to correspond to one of the locking grooves 381, the locking strip 38 is unlocked, that is, the adjusting assembly can be adjusted, and a locking assembly provided with the locking strip 38 and the locking block 40 can facilitate control on the movement of the adjusting assembly, thereby preventing falling of the counterweights 2 due to unintended touches when the adjustment is not needed; and
4. the widths of the inserting openings 22 of the plurality of counterweights 2 from top to bottom are sequentially increased by the distance D, the lengths of the hitching lips 21 are sequentially reduced by the distance D, correspondingly, the plurality of positioning holes 326 are formed below the first adjusting member 34, the spacing distance between every two adjacent positioning holes 326 is D, each of the positioning holes 326 corresponds to a weight gear, the ball 345 matching with the positioning holes 326 is arranged below the first adjusting member 34, and the user can adjust the gear accurately by means of the sound generated between the ball 345 and the positioning holes 326 and the hand feel when adjusting the weight.

Compared with the prior art, the kettlebell in the present invention has the advantages that the mass can be adjusted conveniently and quickly, operations during the adjustment process are easy, and the phenomenon of falling of the counterweights during the use process can be avoided.

The above is merely illustrative of the preferred embodiments of the present invention and is not intended to limit the present invention, and various changes and modifications may be made by those skilled in the art. Any modification, equivalent substitution, improvement, etc. made within the spirit and principles of the present invention should fall within the scope of protection of the present invention.

What is claimed is:

1. A kettlebell, comprising:

a plurality of counterweights placed in a vertically stacked manner, wherein two opposite side edges of each of the counterweights are provided with hitching lips, which protrude outwards and are centrosymmetric relative to the center point of an upper surface of each of the counterweights, and inserting openings, which penetrate through upper and lower surfaces of each of the counterweights and are centrosymmetric relative to the center point of the upper surface of each of the counterweights, each of the counterweights is provided with sliding grooves below the hitching lips, and each of the inserting openings is in communication with the sliding groove formed at the bottom of the corresponding hitching lip of the corresponding counterweight;

widths of the inserting openings on two sides of the counterweights from top to bottom are sequentially increased towards the hitching lips, and correspondingly, lengths of the hitching lips from top to bottom are sequentially reduced; and a lifting base, wherein the lifting base is internally provided with an adjusting assembly, the adjusting assembly comprises a plurality of first load-bearing blocks and a plurality of second load-bearing blocks corresponding to the first load-bearing blocks in number and position, the first load-bearing blocks and the second load-bearing blocks are respectively arranged on two opposite sides of the counterweights, when the first load-bearing block on each layer and the second load-bearing block on each layer sequentially and respectively penetrate through the corresponding inserting openings of the corresponding counterweight on the layer from top to bottom and horizontally move into the sliding grooves below the corresponding hitching lips, the first load-bearing block and the second load-bearing block on each layer can be correspondingly hitched to the corresponding counterweight, and when the first load-bearing blocks and the second load-bearing blocks horizontally move to the corresponding inserting openings, hitching to the counterweights on the corresponding layers is released.

2. The kettlebell according to claim 1, wherein the adjusting assembly further comprises a first adjusting member, a second adjusting member and gears; the plurality of first load-bearing blocks are arranged at a lower end of the first adjusting member, and the plurality of second load-bearing blocks are arranged at a lower end of the second adjusting member; and a driving rack is arranged at an upper end of the first adjusting member, a driven rack matching with the driving rack in shape and size is arranged at an upper end of the second adjusting member, and the driving rack and the driven rack are engaged with each other by means of the gears and can realize synchronous equidistant transmission.

3. The kettlebell according to claim 2, wherein the first adjusting member comprises a first transverse plate and a first vertical plate, and one end of the first transverse plate is perpendicularly mounted at one end of the first vertical plate, so that the first transverse plate and the first vertical plate are combined to form an inverted L-shape;

the driving rack is arranged at a free end of the first transverse plate, the first load-bearing blocks are perpendicularly arranged on a plate surface of the first vertical plate, and the first load-bearing blocks and the first transverse plate are located on the plate surface of the same side of the first vertical plate;

the second adjusting member comprises a second transverse plate and a second vertical plate, and one end of the second transverse plate is perpendicularly mounted at one end of the second vertical plate, so that the second transverse plate and the second vertical plate are combined to form an inverted L-shape; and the driven rack is arranged at a free end of the second transverse plate, the second load-bearing blocks are perpendicularly arranged on a plate surface of the second vertical plate, and the second load-bearing blocks and the second transverse plate are located on the plate surface of the same side of the second vertical plate.

4. The kettlebell according to claim 2, wherein the lifting base comprises an upper shell, a main frame is mounted inside the upper shell, and a lower shell is arranged at a lower end of the upper shell;

a bottom of the main frame is provided with an opening, and the main frame is internally provided with an accommodating space;

the lower shell comprises a limiting cover having a downward opening and configured to cover the stacked counterweights, third sliding grooves are formed at positions of side walls of two sides of the limiting cover corresponding to lower sides of the hitching lips of each of the counterweights respectively, and the third sliding grooves are in communication with an interior of the limiting cover; and the limiting cover of the lower shell enters the accommodating space inside the main frame via the opening at the bottom of the main frame and is fixedly connected to the main frame.

5. The kettlebell according to claim 4, wherein the main frame comprises a top plate, an annular lower frame is arranged below the top plate, a plate surface of the top plate is perpendicular to an opening direction of the lower frame, two connecting metal sheets are oppositely arranged on side edges of two sides of the top plate, an upper end of each of the connecting metal sheets is fixedly connected to the corresponding side edge of the top plate, and lower ends of the two connecting metal sheets are fixedly connected to an outer ring edge of the lower frame respectively, so that the accommodating space enclosed by the top plate, the lower frame and the two connecting metal sheets is formed in a middle of the main frame.

6. The kettlebell according to claim 4, wherein the first adjusting member and the second adjusting member are slidably connected to a top of the main frame respectively, the gears are rotatably connected to the top of the main frame, and when the first adjusting member and the second adjusting member are mounted on the main frame, the first load-bearing blocks and the second load-bearing blocks can respectively pass through the corresponding third sliding grooves and move in the third sliding grooves to be hitched to the hitching lips.

7. The kettlebell according to claim 2, wherein a ball is arranged on the first adjusting member, a plurality of positioning holes are formed at a position inside the lifting base corresponding to a mounting position of the ball, and a hole diameter of the positioning holes is smaller than a ball diameter of the ball; and a connecting line of the centers of the plurality of positioning holes is parallel with a movement direction of the first adjusting member, a spacing distance between the centers of every two adjacent positioning holes is D, and the ball rolls inside the plurality of positioning holes and on the connecting line thereof.

8. The kettlebell according to claim 1, wherein a locking strip is arranged at a lower end of the adjusting assembly, a locking block is arranged at a position of the lifting base corresponding to the locking strip, the locking block can slide up and down in a limited manner inside the lifting base, the locking strip is provided with a plurality of locking grooves in a movement direction of the adjusting assembly, a clamping section is arranged at a position of the locking block corresponding to the locking grooves, the adjusting assembly cannot move when the clamping section is located inside one of the locking grooves, an unlocking groove is formed below the clamping section, when the locking block moves upwards to enable the unlocking groove to correspond to one of the locking grooves, the locking strip is unlocked, and at this moment, the adjusting assembly can move.

9. The kettlebell according to claim 8, wherein a mounting groove is formed in a position of a lower end of a interior of the lifting base corresponding to the locking strip and is configured to mount the locking block, the locking block can move up and down inside the mounting groove, a locking block limiting plate is arranged above the mounting groove, a spring is further mounted at the top of the locking block, one end of the spring is fixedly connected to the locking block, and the other end of the spring abuts against the locking block limiting plate.

10. The kettlebell according to claim 9, further comprising a base configured to place the counterweights and the lifting base, wherein an abutting column is arranged at a position of an upper surface of the base corresponding to the mounting groove, and when the lifting base is placed on the base, the lower end of the locking block inside the mounting groove of the lifting base abuts against the abutting column.

11. The kettlebell according to claim 1, wherein at least two first limiting grooves are formed in a bottom of each of the counterweights, except for a topmost counterweight, the same number of first limiting protrusions are arranged at positions of a top of each of the counterweights corresponding to the first limiting grooves, and every two adjacent counterweights are stacked in order by means of the first limiting grooves and the first limiting protrusions.

* * * * *